US006328500B1

(12) United States Patent
Rubio

(10) Patent No.: US 6,328,500 B1
(45) Date of Patent: Dec. 11, 2001

(54) SEGMENTED TOY ROADWAY, TOY ROADWAY SEGMENT, AND METHOD OF MAKING SAME

(76) Inventor: Tamara L. Rubio, 2300 Tennyson La., Highland Park, IL (US) 60035

( * ) Notice: Subject to any disclaimer, the term of this patent is extended or adjusted under 35 U.S.C. 154(b) by 0 days.

(21) Appl. No.: 09/490,972

(22) Filed: Jan. 24, 2000

(51) Int. Cl.[7] ..... E01C 5/00; E01B 23/00

(52) U.S. Cl. ..... 404/32; 404/35; 404/41; 238/10 R; 238/10 A; 273/DIG. 30; 104/55; 104/63; 16/4

(58) Field of Search ..... 404/1, 32, 35, 404/39, 41, 53, 72; 446/108, 111, 112, 115, 116, 119, 124, 491; 104/53, 55, 63, DIG. 1; 273/DIG. 30; 238/10 R, 10 A; 16/4, 6, 16

(56) References Cited

U.S. PATENT DOCUMENTS

| | | | | |
|---|---|---|---|---|
| Re. 32,106 | | 4/1986 | Lemelson | 446/138 |
| 914,058 | * | 3/1909 | Martyne | 104/60 |
| 2,052,228 | * | 8/1936 | Horn | 238/10 R |
| 2,862,333 | * | 12/1958 | Gardiol | 446/444 |
| 3,589,064 | | 6/1971 | Harada | 46/243 |
| 3,597,876 | * | 8/1971 | Haji | 446/468 |
| 3,630,524 | | 12/1971 | Cooper et al. | 273/86 R |
| 3,860,237 | * | 1/1975 | Cooper et al. | 463/63 |
| 3,862,874 | | 1/1975 | Hopper et al. | 428/47 |
| 4,078,799 | | 3/1978 | Lahr | 273/86 B |
| 4,106,695 | | 8/1978 | Carella et al. | 238/10 F |
| 4,207,787 | | 6/1980 | Lewallyn | 83/23 |
| 4,241,875 | | 12/1980 | Vandenbrink | 238/10 F |
| 4,242,389 | | 12/1980 | Howell | 428/40 |
| 4,266,769 | | 5/1981 | Saitoh | 273/86 B |
| 4,277,201 | * | 7/1981 | Abell | 404/35 |
| 4,287,130 | | 9/1981 | Dohm et al. | 260/413 |
| 4,352,329 | * | 10/1982 | Fetty et al. | 104/305 |
| 4,376,596 | * | 3/1983 | Green | 404/35 |
| 4,468,910 | | 9/1984 | Morrison | 52/591 |
| 4,504,012 | * | 3/1985 | Fetty et al. | 238/10 F |
| 4,655,784 | | 4/1987 | Rahman | 8/148 |
| 4,671,977 | | 6/1987 | Berry | 428/62 |
| 4,842,194 | | 6/1989 | Halbert | 238/10 B |
| 4,921,741 | | 5/1990 | Mullen | 428/48 |
| 5,160,091 | | 11/1992 | Hesse | 238/10 E |
| 5,203,733 | | 4/1993 | Patch et al. | 446/444 |
| 5,364,204 | * | 11/1994 | MacLeod | 404/35 |
| 5,820,294 | | 10/1998 | Baranowski | 404/36 |
| 5,868,076 | * | 2/1999 | Myus et al. | 104/60 |

* cited by examiner

*Primary Examiner*—H. Shackelford
*Assistant Examiner*—Gary S. Hartmann
(74) *Attorney, Agent, or Firm*—Ryndak & Suri

(57) ABSTRACT

A kit is provided for assembling a closed-loop toy simulation of a roadway comprising at least four curved road segments and at least two straight road segments, each road segment having an upper non-skid surface and at least one marking on such surface that simulates roadway lane markings. A method is provided for constructing a closed-loop toy roadway of a desired shape and length. The method comprises positioning two road segments so they are in substantial longitudinal alignment, connecting the adjacent road segments together by engaging a plurality of loops on one segment with a plurality of hooks on an adjacent segment, and repeating such steps until the desired closed-loop play roadway has been configured. Also provided is a segment for constructing a closed-loop play roadway having a desired shape and length and having on its non-skid upper surface at least one marking that simulates a roadway marking.

20 Claims, 4 Drawing Sheets

40
42a
42b
42c
42d
42e
42f
48
6
10
12b
12c
12d
12m
12n
12o
18b
18c
20c
20f
20n
30
32b
32c
32m
32o
34c
34d
34n
50
52
54
56
58

60
62a
62b
62c
62d
64d
64a
64c
66c
62h
62g
62f
62e
66a
66b
64b 80
84d
82d
82c
82b
82a
12
84a
84c
86c
82e
88d
88c
82f
82g
88b
88a
82h
86a
84b
86b

98'
96
88a
98"
A
96'

68
72
78
76
70'
74
70"

18c
12c
20c

94'
92'
90
82a
20a
80
94"
88
86
88h
92"

SEGMENTED TOY ROADWAY, TOY ROADWAY SEGMENT, AND METHOD OF MAKING SAME

FIELD OF THE INVENTION

The present invention relates to a kit for assembling a closed-loop toy roadway, comprising interconnecting segments that can be configured into a desired shape and length, for young children to follow while playing; for example, in riding their wheeled vehicles. The invention also relates to the individual segments for forming the toy roadway and to a method of constructing the toy roadway from such segments.

BACKGROUND OF THE INVENTION

Parents of young children are often faced with the dilemma of wanting their children to play indoors so they can be readily supervised but having to forego that interest when the child selects a wheeled vehicle, such as a tricycle, to play on.

Various types of toy vehicle roads are available. For example, U.S. Pat. No. 4,842,194 discloses toy road boards comprising plastic panels, connected via square or rectangular Velcro tabs. The boards feature connectable realistic geographical areas depicting a multiplicity of scenes—residential, city, country, and race track—replete with buildings, trees and different ground elevations embossed in the plastic board material. The miniaturized scenes include "roadways" that can be connected from one board to the next. See column 1, lines 60–68, and column 2, lines 58–68 (indicating "city" board, "residential" board, and "off road area" board, for example). However, the roads of the '194 patent are for use with miniature toy vehicles rather than for a child to play on and are not cited as offering a closed-loop configuration. Moreover, such boards typically cannot be configured in a length and form to allow the child to meander from room to room. Nor are such boards cited as being skid-proof.

Similarly, U.S. Pat. No. 4,241,875 features a flexible track made up of a multiplicity of interconnected rigid track sections shaped to define desired vertical and horizontal curvatures, such as banks and hills. The track is made of track sections extending laterally and coupled to permit pivotal displacement of the track segments about an axis. Such track, however, is designed to accommodate road racing vehicles, particularly electrically powered slot car sets (see column 1, lines 5–10), and not children riding wheeled vehicles.

Consequently, a need exists for a roadway that young children may play on, for example, with their tricycles, that is made of a flexible material, that has a skid-proof top surface and backing to ensure the safety of the young child, and that can be configured into a closed roadway of a variety of shapes and lengths.

SUMMARY OF THE INVENTION

Accordingly, one aspect of the present invention provides a kit for assembling a closed-loop simulation of a roadway for young children to play on. The kit comprises at least four curved road segments and at least two straight road segments. The segments have an upper surface, a lower surface, two opposing parallel sides, a front connecting end, a back connecting end, and a width sufficient to accommodate a young child playing thereon, for example, riding a tricycle. Made of a flexible material, the segments can be connected end-to-end by fastening means disposed along a portion of each connecting end so as to form a continuous, closed-looped roadway of virtually any desired length and shape. The segments may also be connected to form a noncontinuous portion of a roadway. The upper surface of the roadway has at least one marking simulating a roadway lane marking, each marking being disposed longitudinally so it is substantially parallel to the two parallel sides of the segment. Typically, the upper surface is of a carpet-like material and has a nonskid backing, similar to that found on carpets. Other materials, however, may be used. The lower surface also has a nonskid surface for restricting movement of the road segment against a supporting surface. Thus, the inventive closed-loop roadway is particularly suited for use both inside and outside a home.

In accordance with yet another aspect of the invention is a segment for forming the roadway. The segment has the features described above. That is, each segment is made of a flexible material, has a straight shape or a curved shape, and comprises two opposing nonskid surfaces, a front connecting end, a back connecting end, and fastening means secured to at least a portion of each connecting end. The fastening means comprises a plurality of loops secured to one connecting end and a plurality of hooks secured to the connecting end of an adjacent segment. On one surface is at least one marking simulating the markings on a roadway. The at least one marking is disposed longitudinally on the segment so that the marking on one segment aligns substantially with the marking on an adjacent segment when the segments are connected end-to-end. Preferably, the markings comprise discontinuous lines that simulate lane markings, for example. Alternatively, the markings may comprise two solid lines of yellow or any other desired color to simulate a no-passing zone, or a solid line of white of any other desired color on one of the parallel sides to connote an outer lane marking.

The present invention also includes a method of constructing the closed-loop simulation of a roadway from the inventive segments. The method comprises: (a) positioning two road segments, having the features described above, so they are adjacent each other and the front connecting portion of one segment aligns with the back connecting portion of the adjacent segment and the fastening means on the adjacent connecting portions—wherein the fastening means comprises a plurality of hooks on one segment and a plurality of loops on the adjacent segment—are in relational cooperation; (b) connecting the adjacent segments by engaging the plurality of loops with the plurality of hooks; (c) positioning an additional segment adjacent the interconnected segments as described in step (a); and (d) repeating steps (b)–(c) until a closed-loop play roadway has been configured of the desired length and shape.

DETAILED DESCRIPTION OF THE INVENTION

Figure 1:
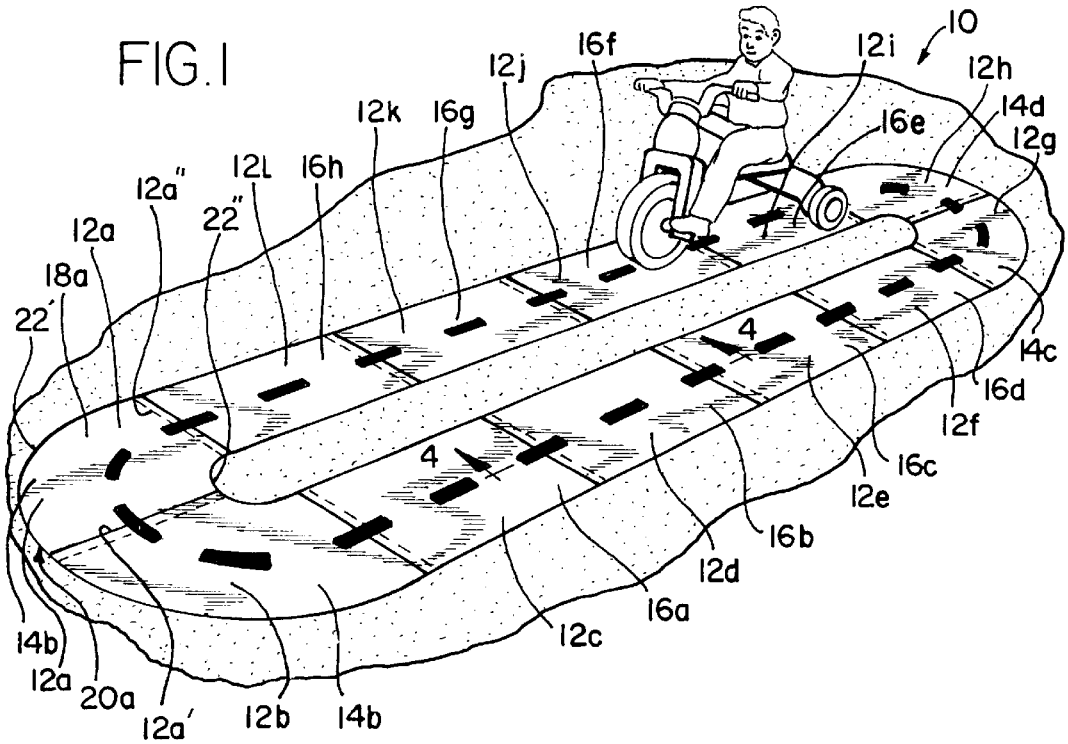
FIG. 1 is a perspective view of the toy roadway in accordance with the invention.

Referring to the figures generally, and to FIG. 1 in particular, there is illustrated a closed-loop toy roadway 10 which has segments 12*a–l*, which include four curved road segments 14*a–d* and eight straight road segments 16*a–h*. The inventive roadway, however, is not restricted to a closed-loop configuration but may also be constructed to simulate a portion of a roadway. Road segment 12*a*, which is representative of the other segments, has a first side 18*a*, a second side 20*a*, two opposing parallel edges 22', 22", a front connecting portion 12*a*', and a back connecting portion 12*a*". Parallel edges 22', 22", front connecting portion 12*a*', and back connecting portion 12*a*" can be bound by any suitable structure, if desired.

Figure 2:
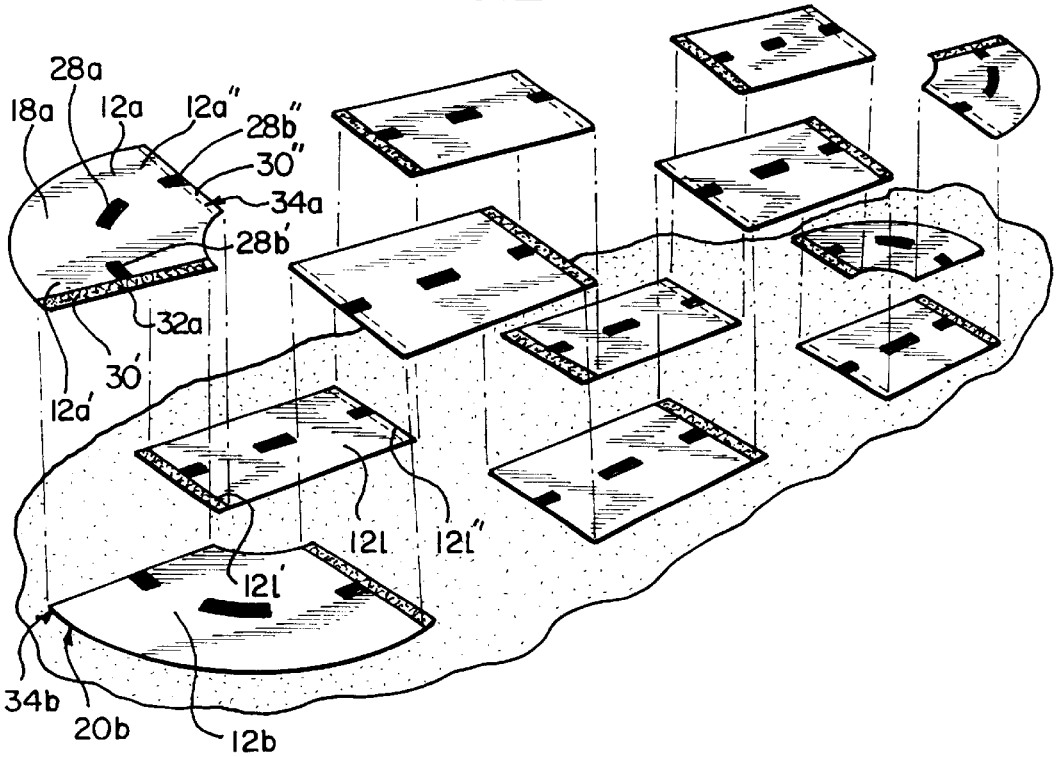
FIG. 2 is a exploded view of the toy roadway shown in FIG. 1.

In accordance with the invention, roadway 10, depicted in FIG. 2, has at least one marking that simulates markings typically found on roadways and highways and may include any one or a combination of single lines, double lines, continuous lines, or discontinuous lines, for example. The markings on one segment align longitudinally with the markings on adjacent segments. In the embodiment shown in FIG. 2, each segment comprises discontinuous markings 28 longitudinally disposed on first side 18*a*. For example, with respect to segment 12*a*, discontinuous markings 28 include one full line 28*a* centered longitudinally and two partial lines 28*b*', 28*b*" extending inwardly from connecting portions 12*a*' and 12*a*". Partial lines 28*b*' and 28*b*" typically have one-half the length of full lines 28*a*.

Figures 4A, 8, 9, 10, 11, 12:
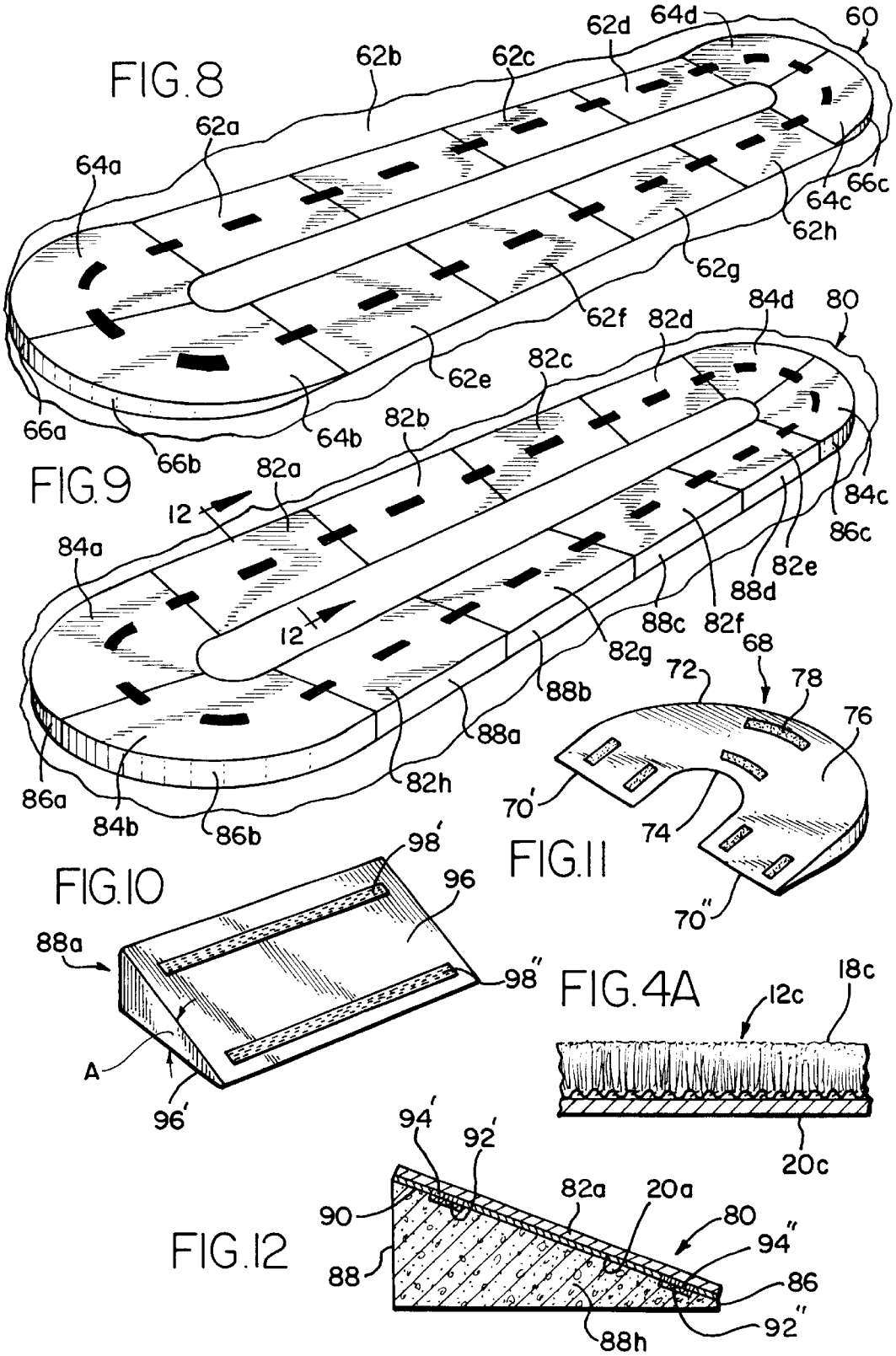
FIG. 4A is a cross-sectional view of toy roadway in accordance with the invention.
FIG. 8 is a perspective view of a toy roadway in accordance with the invention, wherein the curved ends are banked.
FIG. 9 is a perspective view of an alternative embodiment of the toy roadway in accordance with the invention.
FIG. 10 is a perspective view of an alternative embodiment of a banking structure in accordance with the invention.
FIG. 11 is a perspective view of an alternative embodiment of a banking structure in accordance with the invention.
FIG. 12 is a cross-sectional view of the banked roadway of FIG. 9, taken along lines 12—12.

Segment 12*a* generally comprises a flexible material selected from the group consisting of carpet, textiles, rubber, and plastic. Preferably, as shown in FIG. 4A, segment 12*c* comprises carpet material as first side 18*c*. Second side 20*c* typically has a non-skid surface. Preferably, the non-skid surface comprises a synthetic material selected from the group consisting of polyolefin and polyester nylon materials. In an alternative embodiment, the lane marking comprises a phosphorescent material that glows in the dark. In yet another aspect of the invention, the phosphorescent material may be disposed on the unmarked portion of the segment.

In another embodiment, not illustrated, the nonskid backing possesses sufficiently strong adhesion properties which adhere the individual segments to the supporting surface on which they are positioned so as to effectively restrict movement of the segments with respect to the supporting surface and to other segments when positioned adjacent each other. Such embodiment does not include fastening means comprising a plurality of hooks on one segment and a plurality of loops on the adjacent segment. Instead, the nonskid backing serves as a means of attaching the individual segments to each other and to the supporting surface on which they are positioned.

FIG. 2 also illustrates how segments 12*a–l* fit together to yield the inventive closed-loop roadway configuration. In the embodiment shown, segment 12*a* has front connecting portion 12*a*' and back connecting portion 12*a*"; and segment 12*l* has front connecting portion 12*l*' and back connecting portion 12*l*". Segments 12*a* and 12*l* are adjacent and secured to each other in an end-to-end configuration. For example, back connecting portion 12*a*" of segment 12*a* is secured to front connecting portion 12*l*' of segment 12*l*. The remaining segments are similarly connected—i.e., the back connecting portion of one segment is secured to the front connecting portion of the adjacent segment.

As depicted in FIG. 2, fastening means 30 secures the connecting portions to each other. Typically, fastening means 30 is Velcro™ and comprises (a) a plurality of hooks 32 secured to one side of the road segment along at least a section of a connecting end and (b) a plurality of loops 34 secured to at least one side along at least one section of a connecting end of another road segment for connecting the front connecting end of one segment to the back connecting end of a different road segment in end-to-end configuration. In the embodiment shown, segment 12*a* has a plurality of hooks 32*a* secured to and extending outwardly from front connecting portion 12*a*' such that plurality of hooks 32*a* faces upward towards first side 18*a*. Adjacent segment 12*b* has the complementary component of fastening means 30—i.e., a plurality of loops 34*b*—secured in relational orientation to at least a section of the back connecting end on second side 20*b*. Plurality of hooks 32*a* engages plurality of loops 34*b* to secure adjacent segments 12*a* and 12*b* together. In an alternative embodiment, the plurality of hooks may be disposed on the back connecting end and the plurality of loops may be disposed on the front connecting end.

Figures 3, 4, 5, 6, 7:
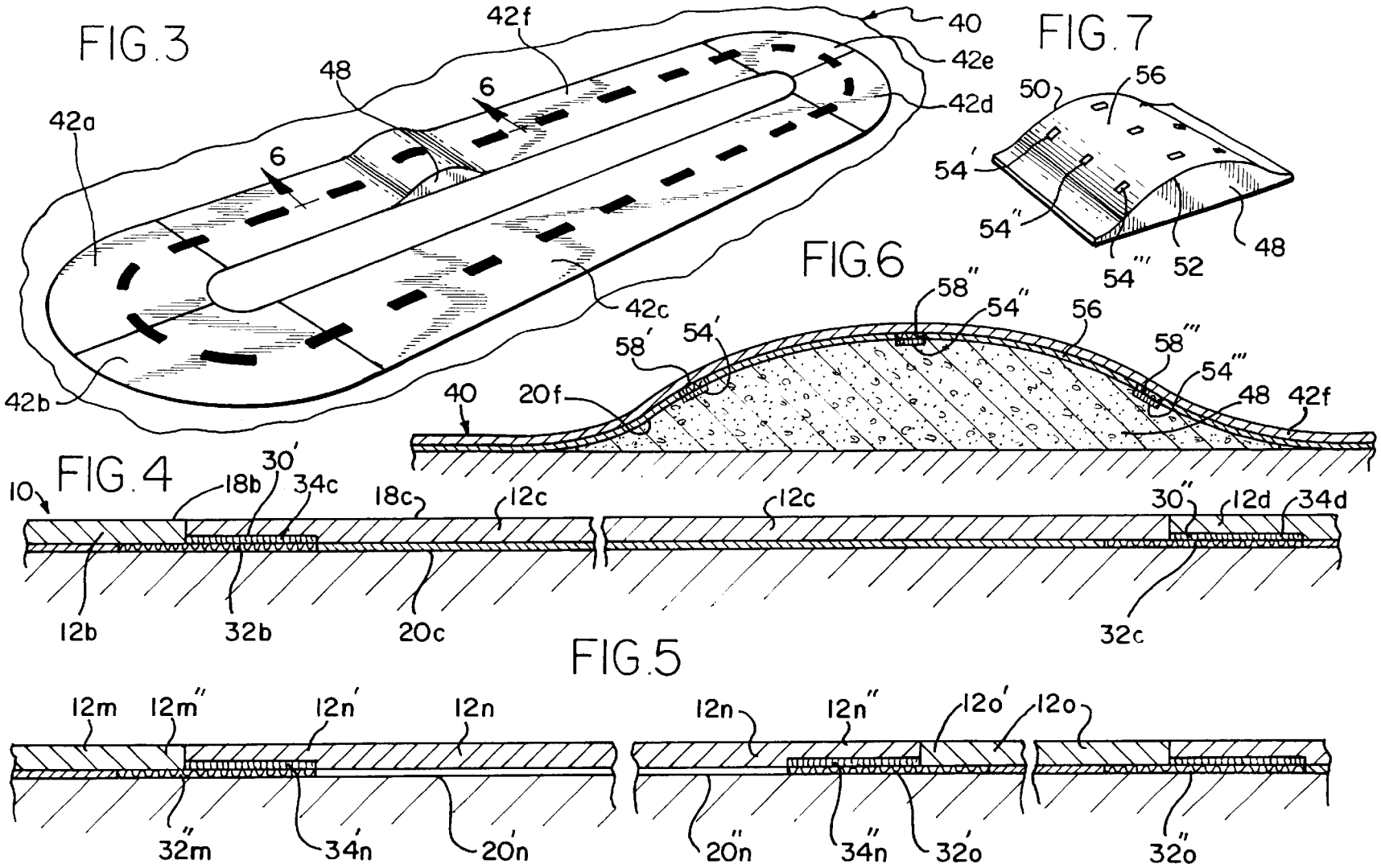
FIG. 3 is a perspective view of a toy roadway in accordance with the invention.
FIG. 4 is a cross-sectional view of the toy roadway of FIG. 1 taken along lines 4—4 of FIG.1.
FIG. 5 is a cross-sectional view of a alternative embodiment of a toy roadway in accordance with the present invention.
FIG. 6 is a cross-sectional view of a banking structure for creating a hill effect, in accordance with the invention.
FIG. 7 is a perspective view of a banking structure in accordance with the invention.

FIG. 4 is a cross-sectional view of roadway 10, taken along lines 4—4 of FIG. 1. Shown in FIG. 4 is the engagement between plurality of loops 34*c* on second side 20*c* of segment 12*c* and plurality of hooks 32*b* on first side 18*b* of segment 12*b*.

In an alternative embodiment, one half of the segments may have the same component of fastening means 30 on both connecting ends—i.e., either loops or hooks—so that the ends are positioned adjacent to segments that have the complementary components. As shown in FIG. 5, for example, segment 12*n* has a plurality of loops 34'*n*,34"*n* secured to second side 20*n*',20"*n* adjacent to each connecting portion 12*n*',12*n*" Adjacent segments 12*m* and 12*o* have plurality of hooks 32"*m* and 32'*o* secured to and extended away from connecting portions 12*m*" and 12*o*', respectively. Plurality of loops 34'*n* engage plurality of hooks 32"*m* to connect segment 12*n* to segment 12*m*, and plurality of loops 34"*n* engage plurality of hooks 32'*o* to connect segment 12*n* to segment 12*o*.

Figure 16:
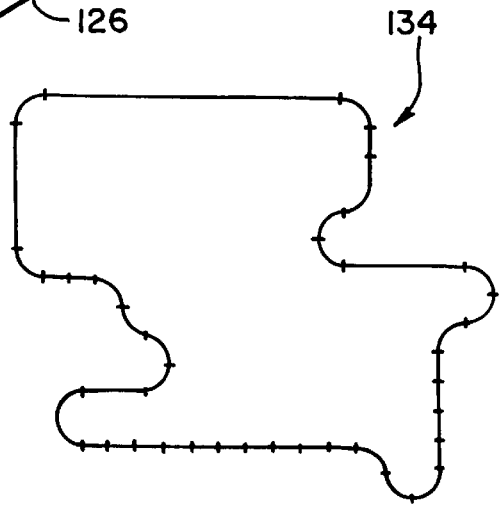
FIG. 16 is a schematic view of one configuration of the toy roadway.

The inventive roadway is not, however, restricted to the configuration shown. For example, as illustrated schematically, in FIG. 16, roadway 134 may be configured to have a variety of shapes and lengths in accordance with the invention, as it may comprise any number of curved segments and any number of straight segments where the straight segments are of any length. For example, a roadway in accordance with the invention may include four straight segments consisting of two segments that are two-, three-, four-, or five-times, for example, longer with respect to the remaining two straight segments. Preferably, however, the straight segments are all of the same or similar length. Further, the size of the individual straight segments may be varied so that segments of several lengths are used in constructing the roadway. Similarly, although the curved segments preferably form an arc of 90°, the curved segments may alternatively form an arc of 180°.

FIG. 3 shows a perspective view of yet another embodiment in accordance with the invention, labeled as roadway 40. Roadway 40 comprises of six segments 42*a–f*, which include only two long, straight segments 42*c,f* and four curved segments 42*a,b,d,e*. Also shown in FIG. 3 is the inclusion of a hill-simulating structure 48 disposed under straight segment 42*f*. Generally, hill-simulating structure 48 may be positioned beneath at least one segment and has a shape that is complementary with such segment. Shown in greater detail in FIG. 7, hill-simulating structure 48 has two parallel edges—i.e., a first parallel edge 50 and a second parallel edge 52—wherein both parallel edges 50,52 are parallel to and in relational cooperation with the two opposing parallel edges 22',22" of segment 42*f*. Fastening means 54',54",54'" are disposed on the upper surface 56 of hill-simulating structure 48 for securing structure 48 to complementary fastening means disposed in relational cooperation on second side 20*f* (not shown) of segment 42*f*. Hill-simulating structure 48 is solid therethrough. Preferably, hill-simulating structure 48 comprises a solid and foam material, such a Styrofoam™, for example.

FIG. 6 is a cross-sectional view of roadway 40, taken through line 6—6 in FIG. 3. FIG. 6 shows segment 42*f* secured to hill-simulating structure 48 via engagement of sets of fastening means 54',54",54'" disposed on upper surface 56 of structure 48 and fastening means 58',58",58'" disposed on second side 20*f* of segment 42*f*. FIGS. 6 and 7 show fastening means 54 disposed in sets of three transversely across upper surface 56 of hill-simulating structure 48; however, the fastening means may be disposed in any desired pattern and in any number. For example, fastening means 54 may be configured in the shape of strips longitudinally positioned along hill-simulating structure 48, strips transversely positioned across such structure, or a plurality of circle(s) or triangles randomly positioned, for example.

Also in accordance with the invention are embodiments providing for transverse embankment of at least a portion of the roadway or, alternatively, the entire roadway by at least about 15°. Examples of such embodiments are roadways 60 and 80, shown in FIGS. 8 and 9, respectively.

Roadway 60 comprises eight straight segments 62*a–h* and four curved segments 64*a–d*. Curved segments 64*a–d* are transversely banked by at least 15°, as each such segment is secured to a curved banking structure 66*a–d* (66*d* not shown). Banking structures 66*a,b* and 66*c,d* each have a shape that is complementary with the segment beneath which it is positioned. Thus, the upper surface of the banking structure 66*a–d* has a curved shape that is complementary to the curved shape of corresponding curved road segment 64*a–d*. Embankment of an entire curved portion of the roadway is achieved by abutting two banking structures. Alternatively, a banking structure such as banking structure 68, shown in FIG. 11, maybe used to embank the entire curved end of the play roadway. At least one transverse end 70',70" of banking structure 68 is tapered to allow the young child to easily ascend or descend the embankment. Banking structure 68 has first edge 72 and a second edge 74 that is parallel to first edge 72, an upper surface 76, and fastening means 78 disposed on upper surface 76 for fixing thereto a segment having complementary fastening means disposed to its second side in relational cooperation. As with fastening means 54 on hill-simulating structure 48, fastening means 78 is generally Velcro™, as described above, and may have a variety of shapes, sizes, and positional orientations. Similarly, first edge 72 and second edge 74 of banking structure 68 are parallel to and in relational cooperation with the two opposing parallel edges of road segments 64*a–d*.

Like roadway 60, roadway 80 shown in FIG. 9 comprises twelve segments. All segments—i.e., eight straight segments 82*a–h* and four curved segments 84*a–d*—are transversely banked by at least 15° as a result of being secured to curved banking structures 86*a–d* (86*d* not shown) and straight banking structures 88*a–h* (88*e–h* not shown), respectively. Shown in FIG. 10 is straight banking structure 88a having upper surface 96 and fastening means 98',98" affixed thereto in the form of longitudinally positioned strips. Fastening means 98',98", however, may be of any size, shape, or positional orientation. Angle A formed between upper surface 96 and bottom surface 96' may be in the range of from 0 (zero) degrees to 20°. Preferably, angle A is 15°. FIG. 12 shows a cross section of banked roadway 80, taken through lines 12—12 of FIG. 9. Shown in FIG. 12 is segment 82*a* affixed to upper surface 90 of banking structure 88h. Fastening means 92',92", affixed to upper surface 90 engages complementary fastening means 94',94" positioned in relational cooperation on second side 20*a* of segment 82*a*. First edge 86 and second edge 88 of banking structure 88*h* are parallel to and in relational cooperation with the two opposing parallel edges of straight segment 82*a*.

Yet another embodiment in accordance with the invention comprises threedimensional structures such as signs, barricades and guard rails simulating those used on actual roadways for positioning at selective sites on the closed-loop play roadway. The signs may included, for example, stop signs, yield signs, rail road crossing signs, and speed limit signs—all of a defined size and color. The barricade may include, for example, an orange and white structure for blocking passage on the closed-loop play roadway. The guard rails may also include reflective chevrons simulating those found near curves on actual roadways. The three-dimensional structures comprise a solid, compressed foam material and a means that allows the structures to stand freely.

Also in accordance with the invention is a method of constructing the inventive, closed-loop toy roadway having at least four curved road segments and at least two straight road segments, as described above. The method comprises (a) positioning two road segments adjacent each other; (b) aligning the front connecting portion of one road segment with the back connecting portion of the adjacent road segment so that the plurality of hooks on one road segment is substantially in relational cooperation with the plurality of loops on the adjacent road segment; (c) engaging the plurality of loops with the plurality of hooks so as to connect the adjacent road segments together; (d) successively positioning another road segment adjacent the interconnected segments; and repeating steps (b)–(c) until a closed-loop play roadway of the desired length and shape has been configured.

In another embodiment of the invention, the method may additionally involve positioning a banking structure as described above beneath at least one of the road segments to transversely bank at least a portion of the segment by an angle from about (0) zero degrees to 45° so as to simulate a hill or an embankment in the toy roadway. Preferably, the banking structure transversely banks the segment by at least 15°.

Another embodiment in accordance with the invention includes a securement step, wherein the segment is attached to the banking structure by fastening means affixed to both the upper surface of the banking structure and the second side of the segment. Typically, as described above, the fastening means is Velcro™.

Figure 13:
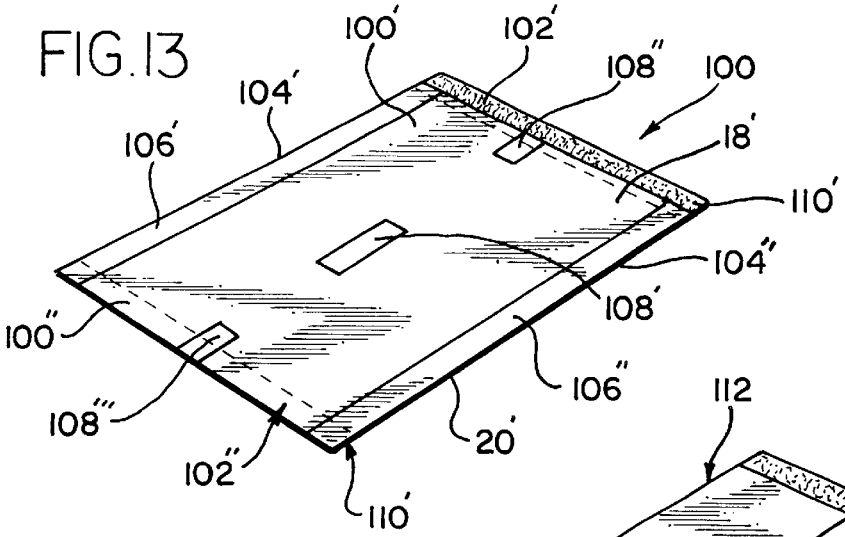
FIG. 13 is a perspective view of a roadway segment in accordance with the invention.

Also in accordance with the invention is a segment for use in constructing the inventive, closed-loop play roadway in any desired shape and length. The segment is substantially as described in detail above and includes both curved- and straight-shaped segments. The curved segments provide a 90° arc or, alternatively a 180° arc. FIG. 13 depicts one embodiment of the inventive segment. Shown in FIG. 13 is segment 100. Segment 100 comprises a flexible material such as carpet, rubber, or plastic. Segment 100 further comprises a first nonskid surface 18', a second surface 20'(not shown), four edges, and fastening means 102',102". Second surface 20' comprises a nonskid surface for securing the segment to a support; such nonskid surface comprises a synthetic material selected from the group consisting of polyolefin and polyester nylon materials. The four edges comprise two parallel edges 104', 104", a front connecting end 100', and a back connecting end 100". Segment 100 has on first surface 18' two solid continuous parallel markings 106',106" simulating roadway markings, each marking being longitudinally disposed so it is substantially parallel to parallel edges 104',104". Segment 100 further includes discontinuous lines 108 comprising one full discontinuous line 108' of a selected length, positioned longitudinally in the center of the segment 100, and two partial discontinuous lines 108",108'", each having one-half the selected length of full discontinuous line 108'. In segment 100, partial discontinuous lines 108',108'" are positioned at each connecting end 100', 100", so they extend away from the connecting end—i.e., towards the center of segment 100.

The simulated roadway markings are not restricted to those shown in FIG. 13, however. The markings may be of any size, length, or shape and may be positioned on any portion of the segment. Generally, however, linear markings are disposed so they are longitudinally parallel to the opposing parallel edges of the segment. For example, the line markings may comprise two solid, adjacent parallel lines, such as parallel lines 113', 113" shown in FIG. 14.

Figure 14:
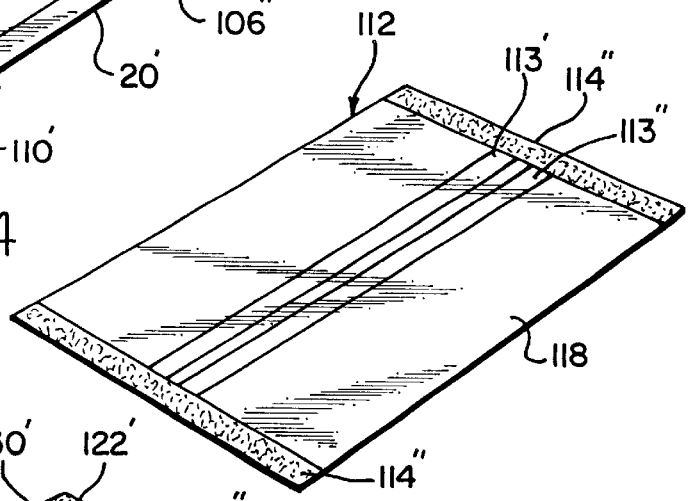
FIG. 14 is a perspective view of an alternative embodiment of a roadway segment in accordance with the invention.

In an alternative embodiment, at least a portion of first surface 118 shown in FIG. 14 may comprise a phosphorescent material that glows in the dark. The phosphorescent material may be used to form either the simulated road markings or the unmarked portion of the segment.

Figure 15:
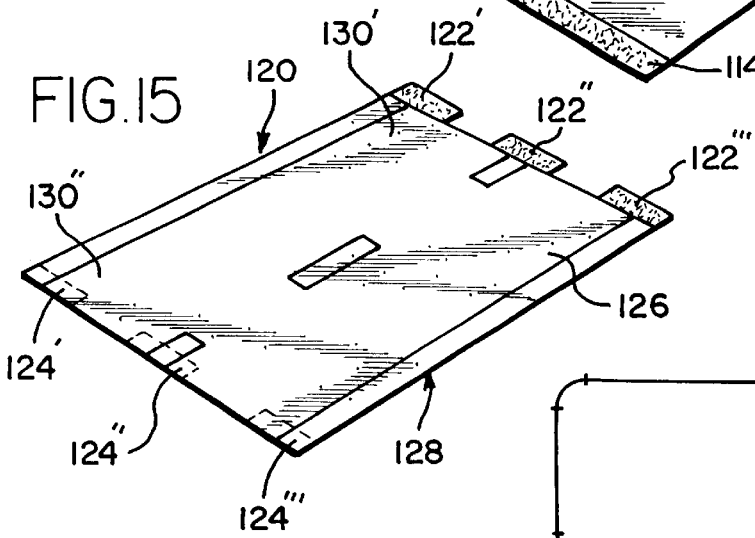
FIG. 15 is a perspective view of an alternative embodiment of a roadway segment, in accordance with the invention, showing fastening means attached to at least one section of the connecting ends.

Fastening means 102',102' on segment 100, shown in FIG. 13, are as described above and are used for connecting front connecting end 100' of segment 100 to the back connecting end of a different road segment in an end-to-end configuration. FIG. 13 shows the fastening means as comprising a plurality of loops 110' disposed on first surface 18' at front connecting portion 100' and a plurality of hooks 110" disposed on second surface 20' at back connecting portion 100". Although FIG. 13 shows fastening means 110 as being disposed across the entire connecting portions of segment 100 and on opposite surfaces, the fastening means may be disposed on the same surface, as shown on segment 112 in FIG. 14. In FIG. 14, fastening means 114',114" is disposed entirely on first surface 118 and comprises a plurality of loops 114',114" at both connecting ends. Segment 112 may then be connected to a different segment (not shown) having a plurality of hooks disposed on both ends of its second surface. In yet another embodiment, the fastening means may be secured to at least one portion of the connecting ends; for example, as shown in FIG. 15. FIG. 15 depicts segment 120, wherein the fastening means comprises a plurality of loops 122',122",122'" disposed on first surface 126 and a plurality of hooks 124',124",124'" disposed on second surface 128. Plurality of loops 122',122", 122'" extends outwardly away from connecting end 130', in the form of "tabs"; plurality of hooks 124',124",124'"is affixed on second surface 128 so they would be in relational cooperation with a similarly disposed plurality of loops on a different, adjoining segment (not shown).

While the invention has been described with reference to certain preferred embodiments, it is to be understood that the invention is capable of numerous changes, modifications, and rearrangements without departing from the scope or spirit of the invention as defined in the claims.

What is claimed is:

1. A kit for assembling a closed-loop toy simulation of a roadway having an inner edge and an outer edge, comprising:

at least four curved road segments and at least two straight road segments;

each said road segment comprising a flexible material and having a first side and a second side, two opposing parallel edges, a front connecting portion and a back connecting portion, and fastening means for connecting the front connecting portion of one road segment to the back connecting portion of a different road segment in an gag end-to-end configuration;

said first side having at least one marking that simulates roadway lane markings, each said marking being longitudinally disposed so it is substantially parallel to said two parallel edges:

said second side of the segment having a nonskid surface for restricting movement of the road segment relative to a supporting surface; and said fastening means comprising (a) a plurality of hooks secured to at least one side along at least a section of a connecting portion of the road segment, and (b) a plurality of loops secured to at least one side along at least a section of a connecting portion of another said road segment;

so that when two of said road segments are positioned adjacent each other, the markings on said adjacent road segments substantially align and the front connecting portion of one of said road segments substantially aligns with the back connecting portion of the other said road segment and the plurality of hooks on one said road segment is substantially in relational cooperation with the plurality of loops on the adjacent road segment and engages the plurality of loops so as to successively connect the road segments together, creating a closed-loop roadway configuration.

2. The kit of claim 1 wherein each curved segment forms an arc of 90 degrees.

3. The kit of claim 1 wherein the flexible material is selected from the group consisting of carpet, rubber, and plastic.

4. The kit of claim 1 wherein the at least one marking is selected from the group consisting of solid continuous lines and discontinuous lines, said discontinuous lines comprising full discontinuous lines having a selected length and partial discontinuous lines having one-half the selected length, said partial discontinuous lines being disposed on the segment to extend away from each said connecting portion.

5. The kit of claim 1 wherein the lane marking comprises a phosphorescent material that glows in the dark.

6. The kit of claim 1 wherein the non-skid surface comprises a synthetic material selected from the group consisting of polyolefin and polyester nylon materials.

7. The kit of claim 1 further comprising a banking structure that when positioned beneath at least one of said segments transversely banks that portion of the roadway by at least about 15 degrees, said banking structure having a shape complementary with the at least one segment beneath which it is positioned;

said banking structure comprising a first edge and a second edge parallel to said first edge, an upper surface comprising the supporting surface, and fastening means attached to the upper surface for securing the segments thereto;

said first edge and said second edge of the banking structure being parallel to and in relational cooperation with the two opposing parallel edges of the segment; and said banking structure comprising a synthetic material selected from the group consisting of solid and foam material.

8. The kit of claim 7 wherein said segments further comprise fastening means on the second side so such fastening means are in relational cooperation with the fastening means on the upper surface of said structure.

9. The kit of claim 7 wherein the upper surface of the banking structure has a curved shape complementary to the curved road segment.

10. The kit of claim 7 wherein the upper surface of the banking structure has a shape complementary to the straight road segment.

11. The kit of claim 1 further comprising a hill-simulating structure to be placed below at least one of said segments.

12. The kit of claim 11 wherein said hill-simulating structure has a cross-section shape of a bell curve.

13. A method for constructing a closed-loop toy roadway of a desired shape and length, wherein the roadway comprises at least four curved road segments and at least two straight road segments;

each said road segment comprising a flexible material and having a first side and a second side, two opposing parallel edges, a front connecting portion and a back connecting portion, and fastening means for connecting the front connecting portion of one road segment to the back connecting portion of a different road segment in an end-to-end configuration;

said first side having at least one marking that simulates roadway markings, each said marking being longitudinally disposed so it is substantially parallel to said two parallel edges;

said second side having a nonskid backing for restricting movement of the road segment relative to a supporting surface; and said fastening means comprising a plurality of hooks and a plurality of loops, said plurality of hooks being secured along at least one section of a connecting portion of the road segment, said plurality of loops being secured to at least one section of a connecting portion of another said road segment;

wherein said method comprises:

(a) positioning two of said road segments adjacent each other;

(b) aligning the front connecting portion of one of said road segments with the back connecting portion of the other said road segment so the plurality of hooks on one said road segment is substantially in relational cooperation with the plurality of loops on the adjacent road segment;

(c) engaging the plurality of loops with the plurality of hooks so as to connect the adjacent road segments together; and (d) positioning another said road segment adjacent the interconnected segments; and repeating steps (b)–(c) until a closed-loop play roadway has been configured of the desired length and shape.

14. The method of claim 13 further comprising the positioning of an elevating structure beneath at least one of said road segments to elevate at least a portion of the at least one segment by an angle of from about (0) zero degrees to 45 degrees so as to simulate a hill or embankment in the toy roadway.

15. A segment for use in constructing a play roadway having a desired shape and length comprising:

a flexible material, a first nonskid surface, a second surface, four edges, and fastening means;

said four edges comprising two parallel edges, a front connecting end, and a back connecting end, said first surface having at least one marking simulating a roadway marking, each said marking being longitudinally disposed so it is substantially parallel to said two parallel edges;

said second surface comprising a nonskid surface for securing the segment to support; and said fastening means comprising a plurality of hooks disposed adjacent the connecting end and a plurality of loops disposed adjacent another said connecting end for connecting the front connecting end of one said road segment to the back connecting end of a different road segment in an end-to-end configuration.

16. The segment of claim 15 wherein each curved segment provides a 90 degree curve.

17. The segment of claim 15 wherein the flexible material is selected from the group consisting of carpet, rubber, and plastic.

18. The kit of claim 15 wherein the at least one marking is selected from the group consisting of solid continuous lines and discontinuous lines, said discontinuous lines comprising full discontinuous lines having a selected length and partial discontinuous lines having one-half the selected length, said partial discontinuous lines being disposed on the segment to extend away from each said connecting portion.

19. The segment of claim 15 wherein at least a portion of the first side comprises a phosphorescent material that glows in the dark.

20. The segment of claim 15 wherein the nonskid surface comprises a synthetic material selected from the group consisting of polyolefin and polyester nylon materials.

* * * * *